US007164404B2

(12) United States Patent
Senda et al.

(10) Patent No.: US 7,164,404 B2
(45) Date of Patent: Jan. 16, 2007

(54) DISPLAY DEVICE

(75) Inventors: Michiru Senda, Gifu (JP); Isao Akima, Ohgaki (JP)

(73) Assignee: Sanyo Electric Co., Ltd., Osaka (JP)

( * ) Notice: Subject to any disclaimer, the term of this patent is extended or adjusted under 35 U.S.C. 154(b) by 109 days.

(21) Appl. No.: 10/625,843

(22) Filed: Jul. 24, 2003

(65) Prior Publication Data

US 2004/0212556 A1 Oct. 28, 2004

(30) Foreign Application Priority Data

Jul. 25, 2002 (JP) ..... 2002-216674

(51) Int. Cl.
*G09G 3/36* (2006.01)

(52) U.S. Cl. ..... 345/90; 345/92

(58) Field of Classification Search ..... 345/83, 345/84, 85, 86–90, 91–95, 96–100, 204
See application file for complete search history.

(56) References Cited

U.S. PATENT DOCUMENTS 4,996,523 A * 2/1991 Bell et al. ..... 345/77
5,952,948 A * 9/1999 Proebsting ..... 341/144
6,049,321 A * 4/2000 Sasaki ..... 345/99
6,333,729 B1 12/2001 Ha
6,452,526 B1 * 9/2002 Sagawa et al. ..... 341/144
6,600,472 B1 7/2003 Nakai et al.
6,731,272 B1 * 5/2004 Huang ..... 345/204
6,747,623 B1 * 6/2004 Koyama ..... 345/87
6,864,874 B1 * 3/2005 Ozawa ..... 345/99
6,972,745 B1 * 12/2005 Pfeiffer et al. ..... 345/89
2002/0021274 A1 * 2/2002 Koyama et al. ..... 345/98
2002/0041266 A1 * 4/2002 Koyama ..... 345/87
2002/0063666 A1 5/2002 Kang et al.
2002/0097215 A1 7/2002 Huang
2002/0154106 A1 * 10/2002 Tsutsui ..... 345/204
2003/0090478 A1 * 5/2003 McKnight ..... 345/204
2003/0234755 A1 * 12/2003 Koyama ..... 345/82
2004/0222955 A1 * 11/2004 Koyama ..... 345/87

FOREIGN PATENT DOCUMENTS

EP 0-365-445 A2 4/1990

(Continued)

OTHER PUBLICATIONS

European Search Report mailed on Aug. 16, 2006 for European Application No. 03016964.3 filed on Dec. 17, 2003, 4 pages.

*Primary Examiner*—Nitin Patel
(74) *Attorney, Agent, or Firm*—Morrison & Foerster LLP

(57) ABSTRACT

A digital image signal is serially transferred to each of pixels through a drain signal line. The digital image signal is sampled at pixel selecting transistors, converted from a serial signal to a parallel signal, and then converted to an analog image signal by a DA converter. This DA converter includes a plurality of capacitor electrodes coupled to a pixel electrode at a weighted capacitance ratio and a clock supplying portion for supplying periodic clock signals to the plurality of the capacitor electrodes in response to the digital image signal. The analog image signal is applied to the pixel electrode. This simplifies a configuration of peripheral circuits of the pixel, and accordingly reduces the frame area of a panel and the number of wiring lines.

9 Claims, 9 Drawing Sheets

FOREIGN PATENT DOCUMENTS

| | | | | |
|---|---|---|---|---|
| EP | 0-797-182 | A1 | | 9/1997 |
| EP | 1-139-327 | A | | 10/2001 |
| JP | 01118195 | A | * | 5/1989 |
| JP | 01-193716 | A | | 8/1989 |
| JP | 11-38946 | | | 2/1999 |
| JP | 11-271713 | A | | 10/1999 |
| JP | 2002-123232 | | | 4/2002 |
| KR | 1999-9631 | | | 2/1999 |
| KR | 2002-0026801 | | | 4/2002 |
| KR | 2002-55991 | | | 7/2002 |

* cited by examiner

DISPLAY DEVICE

BACKGROUND OF THE INVENTION

1. Field of the Invention

The invention relates to a display device, particularly to a display device having a DA converter for converting a digital image signal to an analog image signal.

2. Description of the Related Art

There has been a great demand on the market for portable display devices such as a portable TV and a portable telephone. All these devices need a small, lightweight and low power consumption display device, and development efforts have been made accordingly.

FIG. 10 is a circuit diagram of a pixel of a conventional liquid crystal display device. A gate signal line 51 and a drain signal line 61 are formed on an insulating substrate (not shown), crossing each other. In a peripheral of the crossing, a pixel selecting thin film transistor 72 is provided, being connected to both the signal lines 51 and 61. Hereinafter, a thin film transistor is referred to as "TFT". A source 11*s* of the pixel selecting TFT 72 is connected to a display electrode 80 of a liquid crystal 21.

A storage capacitor 85 for retaining a voltage of the display electrode 80 for one field period is provided. One terminal 86 of the storage capacitor 85 is connected to the source 11*s* of the pixel selecting TFT 72, and another terminal 87 is applied with an electric potential common to all the pixels.

Here, when a scanning signal (high level) is applied to the gate signal line 51, the pixel selecting TFT 72 turns on, and an analog image signal is transferred to the display electrode 80 from the drain signal line 61 and retained in the storage capacitor 85. The image signal voltage applied to the display electrode 80 is applied to the liquid crystal 21. The liquid crystal 21 aligns itself in response to the voltage, resulting in a liquid crystal display. Accordingly, a liquid crystal display of either a motion picture or a still picture is obtained.

The analog image signal inputted to the drain signal line 61 is obtained by converting an inputted digital image signal to an analog image signal by a DA (digital-to-analog) converter. Conventionally, in a liquid crystal display device which is integrated with the DA converter in a display panel, the DA converter is placed adjacent a driver circuit in a peripheral of the pixel.

In the conventional liquid crystal display device, since the DA converter is placed adjacent the driver circuit, peripheral circuits of the pixel are complicated, providing a problem of increasing a frame area of the display panel. Particularly, when a gray-scale voltage is inputted from an outside, the number of the terminals increases by the number of the gray-scale signals.

Furthermore, since the analog data converted by the DA converter is written in the pixel through the pixel selecting TFT 72, a voltage of a sum of the maximum amplitude voltage and Vth, or higher needs to be supplied as a scanning signal. Here, Vth is a threshold voltage of the pixel selecting TFT 72. Therefore, it is difficult to lower the voltage and the power consumption of the liquid crystal display device.

SUMMARY OF THE INVENTION

The invention provides a display device having a plurality of pixels. Each of the pixels includes a serial-to-parallel converter converting a serial digital image signal supplied serially to the display device to a parallel digital image signal, a DA converter converting the parallel digital image signal to an analog image signal, and a pixel electrode configured to receive the analog image signal.

The invention also provides another display device that includes a drain signal line configured to receive a serial digital image signal serially supplied to the display device, a plurality of pixel selecting transistors connected to the drain signal line and selecting a pixel of the display device, and a plurality of shift registers. Each of the shit registers supplies a sampling pulse to a gate of the corresponding pixel selecting transistor for sampling the serial digital image signal at a predetermined timing to produce a parallel digital image signal. The display device also includes a data retaining portion retaining the parallel digital image signal converted from the serial digital image signal, a pixel electrode of the pixel, a plurality of capacitor electrodes coupled with the pixel electrode, and a clock supplying portion supplying a periodic clock signal to the capacitor electrodes in response to the parallel digital image signal retained in the data retaining portion. Each of the capacitance electrodes has a weighted capacitance ratio to couple with the pixel electrode.

DETAILED DESCRIPTION OF THE INVENTION

Figure 1:
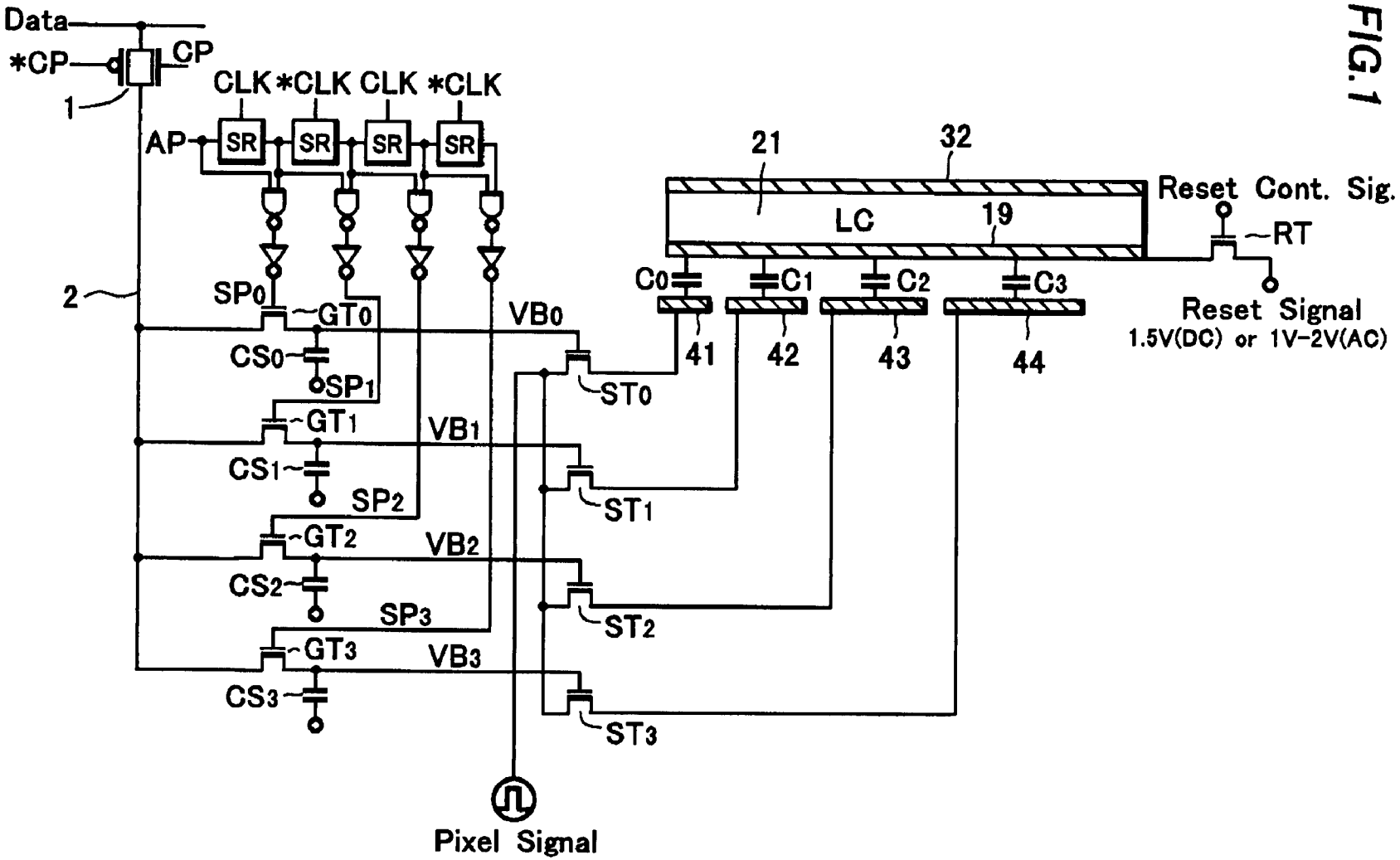
FIG. 1 is a circuit block diagram of a liquid crystal display device according to a first embodiment of the invention.

Next, a display device according to a first embodiment of the invention will be described with reference to FIGS. 1–5. FIG. 1 is a circuit diagram of the liquid crystal display device of the first embodiment. Although only a single pixel is shown in the figure for simplification, a plurality of the pixels is arranged in a matrix in the display device.

A digital image signal is serially transferred from a drain driver (not shown) and supplied to a drain signal line 2 through a transmission gate 1. Control clocks CP and *CP (*CP is an inverted clock of CP) control turning on and off of the transmission gate 1.

Drains of pixel selecting transistors GT0 to GT3 are commonly connected to a drain signal line 2. Sampling pulses SP0 to SP3 for sampling a digital image signal at a predetermined timing are severally supplied to each gates of the pixel selecting transistors GT0 to GT3.

Figure 2:
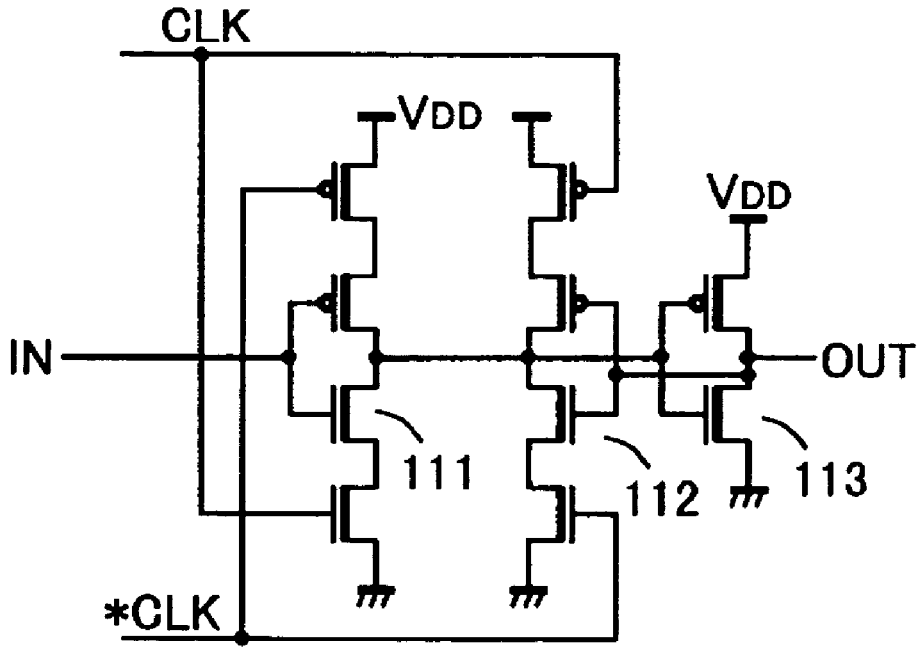
FIG. 2 is a circuit diagram of a shift register of FIG. 1.

These sampling pulses SP0 to SP3 are generated by shift registers SR. As shown in FIG. 2, the shift register SR includes clocked inverters 111 and 112 which are applied with shift clocks CLK and *CLK(*CLK is an inverted clock of CLK) and an inverter 113. The shift registers SR sequentially shift an input clock AP in response to the shift clocks CLK and *CLK, thereby providing the sampling pulses SP0 to SP3 from each stages of the shift registers SR.

Sources of the pixel selecting transistors GT0 to GT3 are connected to capacitors CS0 to CS3 for retaining each bit data of a digital image signal written in through the pixel selecting transistors GT0 to GT3.

The bit data retained in the capacitors CS0 to CS3 are severally supplied to gates of clock supplying transistors STO to ST3 which are provided at the next stage. Sources of the clock supplying transistors STO to ST3 are supplied with pixel signals (periodic clocks). Drains of the clock supplying transistors STO to ST3 are connected to capacitor electrodes 41, 42, 43, and 44, which are coupled to the pixel electrode 19 through capacitance coupling.

Therefore, capacitors C0, C1, C2, and C3 are formed between the pixel electrode 19 and the capacitor electrodes 41, 42, 43, and 44. A liquid crystal 21 is filled between the pixel electrode 19 and a common electrode 32.

The clock supplying transistors ST0 to ST3 turn on or off in response to each bit data of the digital image signal, which are supplied from the drain signal line 2 and retained at the capacitors CS0 to CS3 through the pixel selecting transistors GT0 to GT3. For example, when the clock supplying transistor ST0 turns on, a pixel signal is applied to the capacitor electrode 41 through the clock supplying transistor ST0. Accordingly, a voltage change ΔV occurs at the pixel electrode 19 in response to a voltage amplitude $V_{P\text{-}P}$ of the clock and a capacitance value C0.

$$\Delta V = C0 \cdot V_{P\text{-}P}(CLC + C0) \quad (1)$$

Here, CLC is a value of capacitor between the pixel electrode 19 and the common electrode 32. Therefore, by assigning weights to the capacitors C0, C1, C2, and C3, corresponding to each bits of the digital image signals, a voltage of the corresponding analog image signal converted from the digital image signal is supplied to the pixel electrode 19.

The above ΔV can be generally presented in a following equation:

$$\Delta V = \Sigma C \cdot V_{P\text{-}P}/(CLC + \Sigma C) \quad (2)$$

$$\Sigma C = n0 \cdot C0 + n1 \cdot C1 + n2 \cdot C2 + n3 \cdot C3 \quad (3)$$

Here, n0, n1, n2, and n3 are digital image signal data, and each of those is severally "1" or "0". Here, the areas of the electrodes or the distances between the electrodes are set to satisfy, for example, C1=2C0, C2=$2^2$C0, and C3=$2^3$C0 in each coupling capacitors, weighting the capacitance values.

The pixel electrode 19 is provided with a reset transistor RT for supplying a reset signal. This makes it possible to perform an inverting driving method in which an inverted voltage is alternately applied to the liquid crystal 21, as described later.

Next, operation of the liquid crystal display device having the above described configuration will be described with reference to the drawings.

Figure 3:
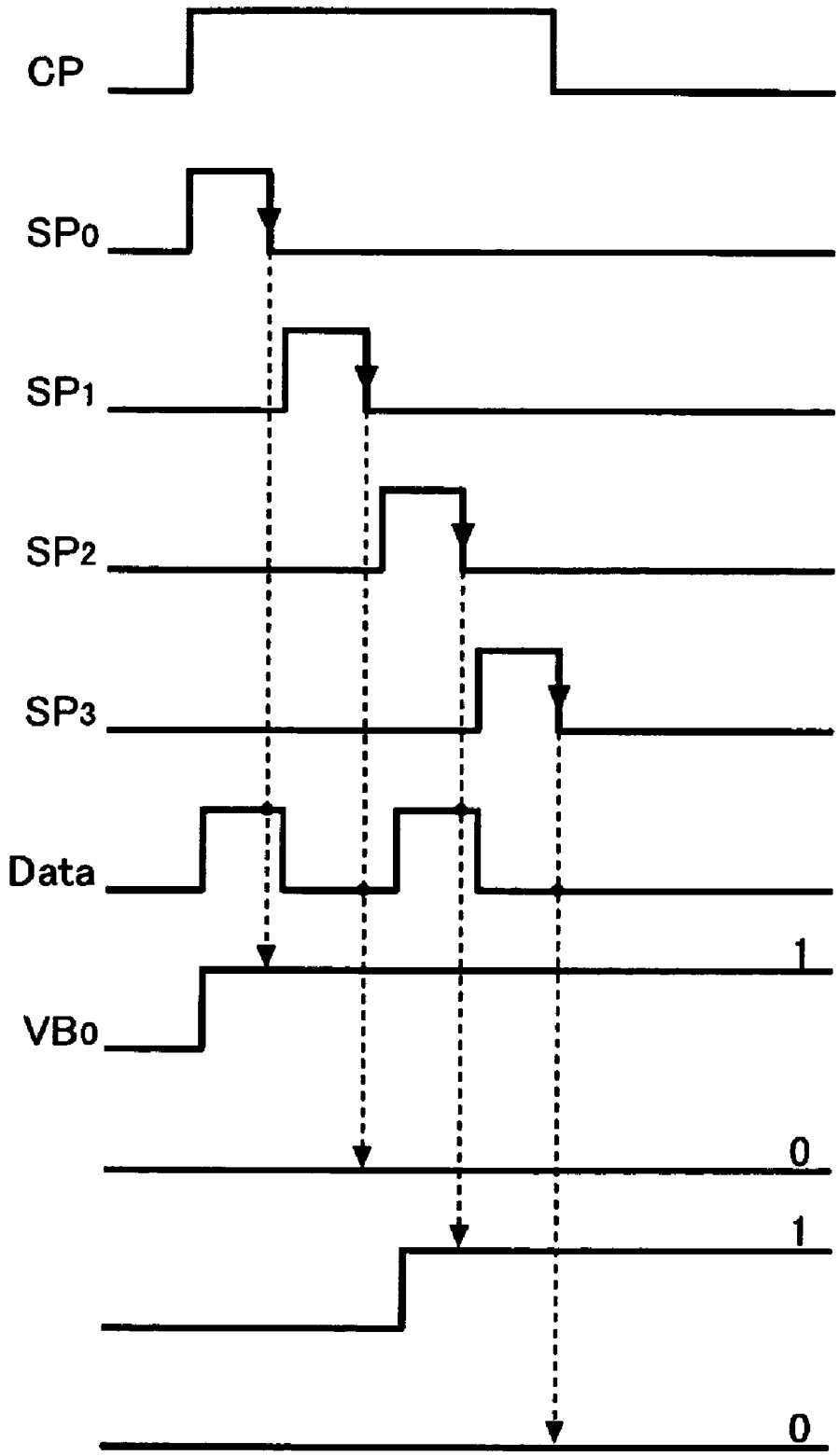
FIG. 3 is a timing chart of an operation of the liquid crystal display device of FIG. 1.
Figure 4:
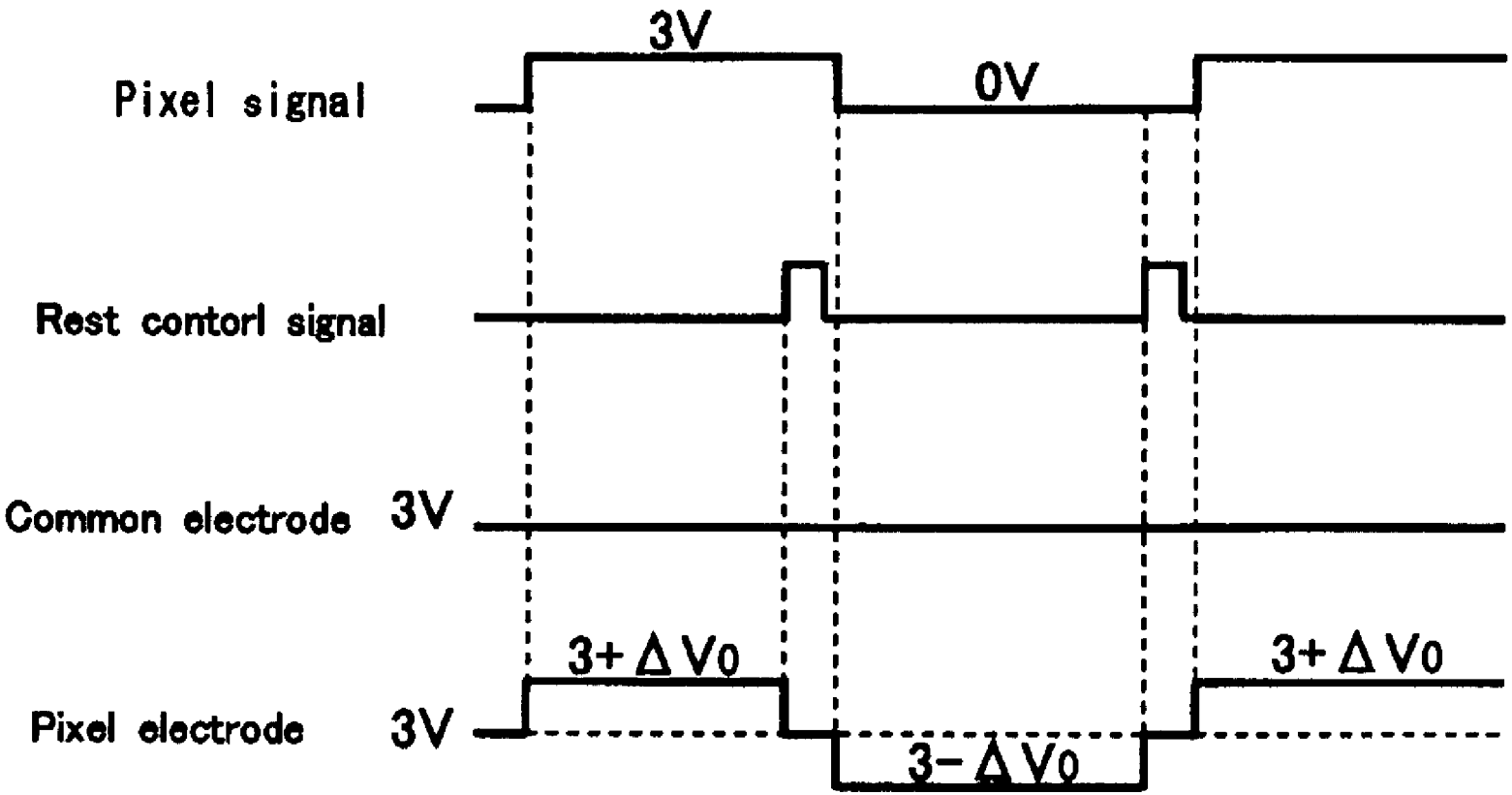
FIG. 4 is another timing chart of the operation of the liquid crystal display device of FIG. 1.

FIGS. 3 and 4 are timing charts of the liquid crystal display device. The operation of serial-to-parallel conversion will be described with reference to FIG. 3 first. When the control clock CP turns to a high level, the transmission gate 1 turns on so that digital image signal data is transmitted through the transmission gate 1 and supplied to the drain signal line 2 as serial data in time series. Each bit data of the digital image signal are sampled by the sampling pulses SP0 to SP3, converted to parallel data through the pixel selecting transistors GT0 to GT3, and retained at the capacitors CS0 to CS3. In FIG. 3, the digital image signal data of four bits (1, 0, 1, 0) are retained.

Next, the operation of AD conversion after the conversion to the parallel data will be described. The pixel signal is a signal which is supplied to the capacitor electrodes 41 to 44 through the transistors ST0 to ST3, alternating between 0V and 3V at a predetermined period. A reset control signal is a signal which is supplied to the gate of the reset transistor RT. The reset control signal is a pulse signal which turns to a high level immediately before the pixel signal is inverted. The common electrode 32 is fixed at a DC level of, for example, 3V.

Suppose that serial data of a digital image signal supplied to the drain signal line 2 is converted to, for example, four-bit parallel data (1, 0, 0, 0) by the described operation of the serial-to-parallel conversion. Then, among the capacitors CS0 to CS3, to which each data is supplied through the pixel selecting transistors GT0 to GT3, CS0 supplied with data of "1" is charged, and the CS1 to CS3 are discharged so that data (1, 0, 0, 0) are retained therein. Accordingly, the clock supplying transistor ST0 turns on and the clock supplying transistors STI to ST3 turn off, so that a pixel signal is applied to the capacitor electrode 41 through the clock supplying transistor ST0.

When a voltage of the pixel signal changes from 0V to 3V, since the capacitor electrode 41 is coupled to the pixel electrode 19 through capacitance coupling, a voltage of the pixel electrode 19 rises from 3V, which is the same potential as that of the common electrode 32, by AVO, which is a potential corresponding to a capacitance of the capacitor electrode 41 and the pixel electrode 19. Similarly, if other bit of the four bit data is inputted, the clock supplying transistors ST0 to ST3 turn on or off in response to "1" or "0" of the bit so that the potential of the pixel electrode 19 changes to a potential corresponding to the four-bit data of the digital image signal. The four-bit data of the digital image signal are retained in the capacitors CS0 to CS3. When the electric charge retained in the capacitors CS0 to CS3 is discharged by leakage at the transistors and so on and the charge becomes lower than a threshold value of the transistors ST0 to ST3, the data are vanished. Therefore, the data need to be refreshed before it is vanished.

By retaining the data in a data retaining portion having the capacitors CS0 to CS3 as described above, a frame rate can be lowered to a minimum frequency required for refreshing the data at the data retaining portion, thereby reducing power consumption of the display device. Furthermore, since the DA converter is not provided in the periphery of the driver circuit but integrated in a pixel by capacitance coupling, the frame of the display device is narrower than the that of the conventional display device.

Next, when the reset signal turns to a high level, the reset transistor RT turns on, resetting the voltage of the pixel electrode 19 to a potential equal to the potential of the common electrode 32, i.e., 3V. After the reset signal returns to a low level, the voltage of the pixel signal changes from 3V to 0V. Accordingly, the voltage of the pixel electrode 19 is reduced from 3V by ΔV0 by capacitance coupling. The pixel electrode 19 changes its voltage, inverting the voltage around the voltage of the common electrode 32, thereby enabling the driving of the display device without degrading the liquid crystal 21.

The cycle of refreshing the data at the data retaining portion can be independent of the cycle of inverting the pixel signal voltage, without any synchronization. For more reduction of the power consumption, it is preferable to set each of the cycles at the longest as long as the cycles severally satisfy necessity of refreshing the data at the data retaining portion and necessity of inverting the pixel signal for preventing degrading of the liquid crystal. However, if the circuit is driven by refreshing the data, a noise can be generated in a picture by a parasitic capacitance between wiring lines in the circuits. Therefore, it is most preferable to synchronize the cycles and to set each of the cycles as long as possible.

Figure 5:
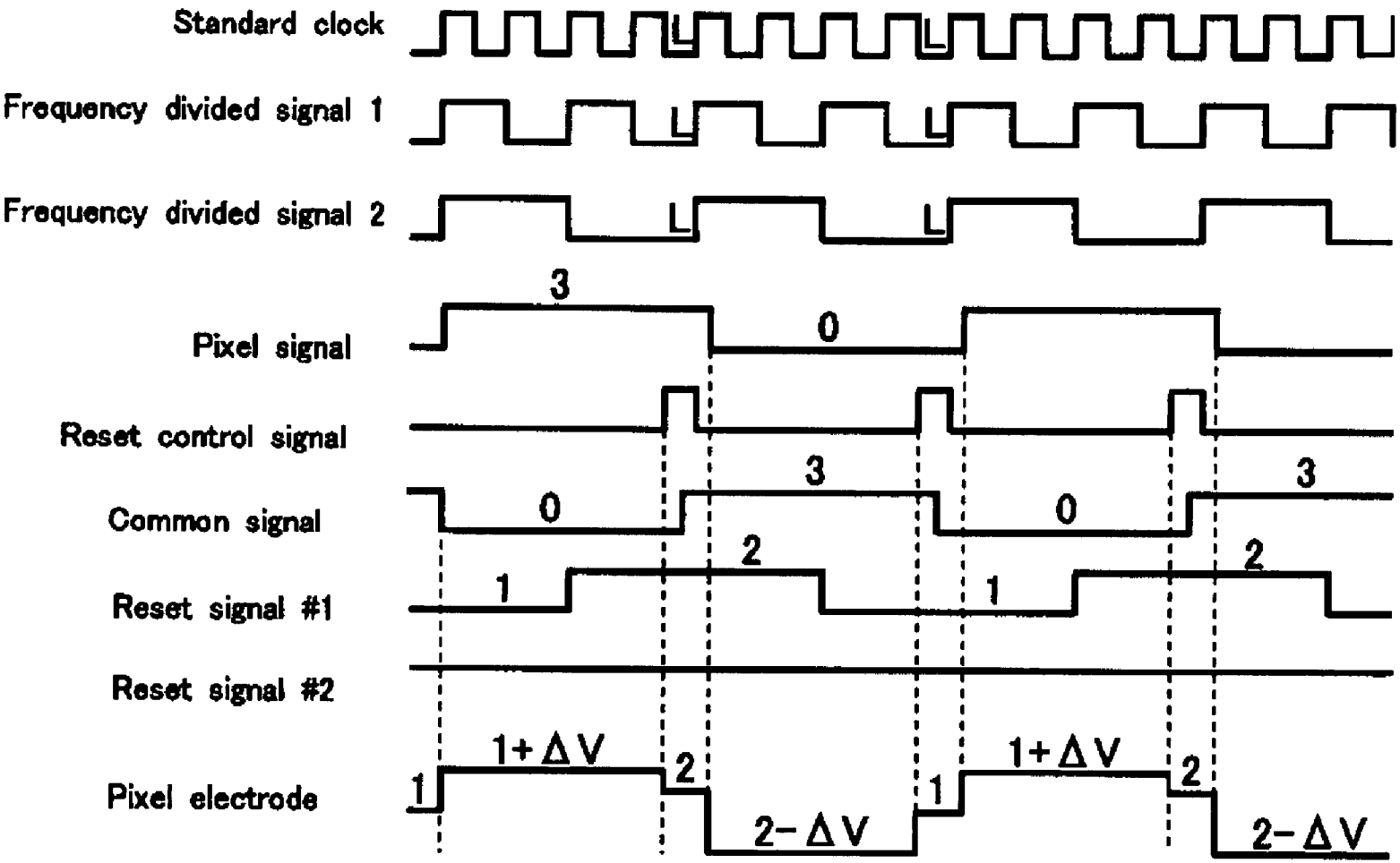
FIG. 5 is a timing chart of another operation of the liquid crystal display device of FIG. 1.

FIG. 5 is another timing chart of the liquid crystal display device. This figure also shows the timing of operating the AD conversion after conversion to parallel data. In this case, the common electrode 32 is AC-driven. The pixel signal is obtained by dividing frequencies of a standard clock and delaying those, and has voltage amplitudes of 0V and 3V. There is a difference in phase between common signal supplied to the common electrode 32 and the pixel signal.

The reset transistor RT resets the voltage of the pixel electrode 19 at a level of a reset signal #1 or a reset signal #2 in response to a reset control signal. In the figure, the reset signal #1 is selected. The reset signal #1 is a signal which changes before the changing of the common signal and immediately before or simultaneously with turning high of the reset control signal Here, the common electrode is at 0V, and when the reset control signal turns to a high level, the pixel electrode is reset at 2V.

Then, when the reset signal returns to a low level and the pixel signal is inverted to 0V, the electric potential of the pixel electrode 19 is reduced from 2V by ΔV by capacitance coupling between the capacitor electrodes 41 to 44 and the pixel electrode. As apparent from this timing chart, the pixel electrode 19 is driven to alternately invert its voltage with the voltage of the common electrode 32 as a standard.

Figure 6:
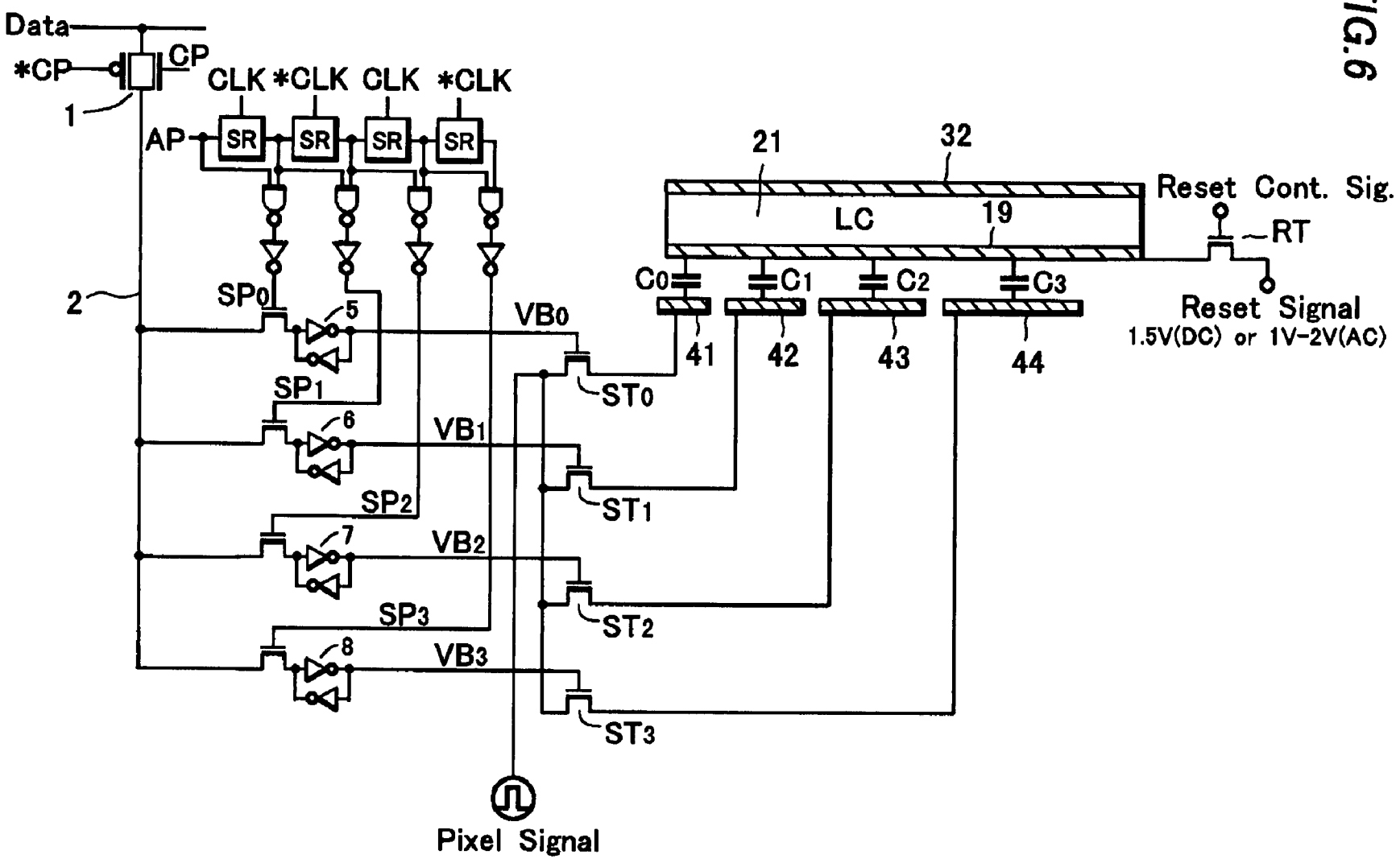
FIG. 6 is a circuit block diagram of a liquid crystal display device according to a second embodiment of the invention.

Next, a display device according to a second embodiment of the invention will be described with reference to FIG. 6. FIG. 6 is a circuit diagram of the display device of the second embodiment. Although this figure shows a single pixel for simplification, a plurality of the pixels is arranged in a matrix in the display device. The same reference numerals as those of FIG. 1 are given to the same elements as those of FIG. 1, which are already described in the first embodiment, and the descriptions thereof are omitted here.

In this embodiment, static memory circuits 5 to 8 are provided, replacing the capacitors CS0 to CS3 for retaining the data provided in the first embodiment. This is a difference between the embodiments. The static memory circuits 5 to 8 each include two inverter circuits with positive feedback. Although it is necessary to refresh the data for retaining the data in the first embodiment, in this embodiment the data is retained by the static memory circuit without refreshing operation. Furthermore, for displaying a still picture, the data retained in the data retaining portion can be displayed as a still picture while stopping external circuits and each driver circuit. This makes it possible to lower the power consumption, comparing to the first embodiment. However, the number of elements increases and circuits are more complicated so that a larger area is required, comparing to the first embodiment. The operation of this display device is the same as that of the first embodiment, so that the description is omitted here.

Next, an example of applying the embodiments to a reflective liquid crystal display device will be described. A device configuration of the reflective liquid crystal display device will be described with reference to FIG. 7.

Figure 7:
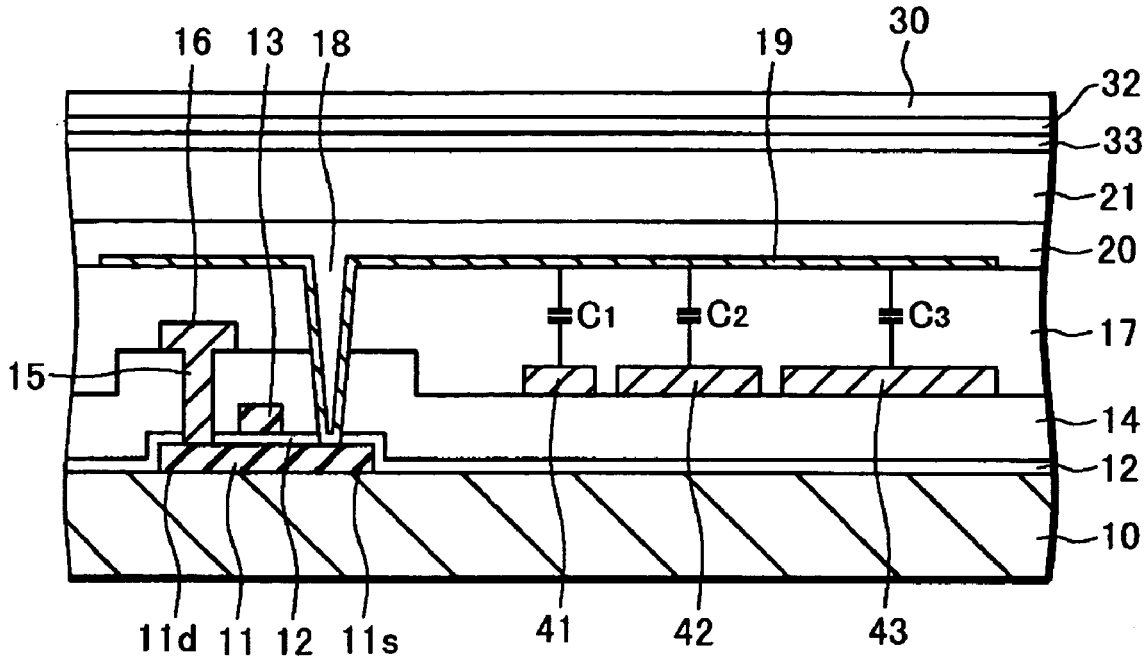
FIG. 7 is a cross-sectional view of a device configuration of a reflective liquid crystal display device used in the first embodiment.

As shown in FIG. 7, a semiconductor layer 11 made of polycrystalline silicon is formed like an island on one insulating substrate 10, and a gate insulating film 12 is formed on the semiconductor layer 11 and the insulating substrate 10. A gate electrode 13 is formed above the semiconductor layer 11 with the gate insulating film 12 interposed therebetween. A source 11*s* and a drain 11*d* are formed in the semiconductor layer 11 at both sides of the gate electrode 13. The TFT having such a configuration is used for the pixel selecting transistors GT0 to GT3 or the reset transistor RT. The configuration shown in this figure is for the reset transistor RT.

An interlayer insulating film 14 is laminated on the gate electrode 13 and the gate insulating film 12. A contact hole 15 is formed in a position corresponding to the drain 11*d*, and the drain 11*d* is connected to a drain electrode 16 through the contact hole 15. The source 11*s* is connected to the pixel electrode 19 through the contact hole 18 provided in the interlayer insulating film 14 and a planarization insulating film 17 provided on the interlayer insulating film 14. The capacitor electrodes 41, 42, and 43 made of Al (aluminum) are formed on the interlayer insulating film 14, away from the TFT. The capacitor electrodes 41, 42, and 43 are coupled to the pixel electrode 19 through capacitance coupling, thereby forming the capacitors C1, C2, and C3.

The pixel electrode 19 formed on the planarization insulating film 17 is made of a reflective material such as Al. An alignment film 20, which aligns the liquid crystal 21 and is made of polyimide, is formed on the pixel electrode 19 and the planarization insulating film 17.

A color filter which provides. each colors of red (R), green (G) and blue (B), the common electrode 32 formed of a transparent conductive film made of, for example, ITO (indium tin oxide), and an alignment film 33, which aligns the liquid crystal 21, are formed on another insulating substrate 30 in this order. The color filter is unnecessary if a color picture is not to be displayed.

The pair of the insulating substrates 10 and 30 thus formed is attached at its periphery with an adhesive sealing material. A space formed by the attached substrates is filled with the liquid crystal 21, completing the reflective liquid crystal display device.

Figure 8:
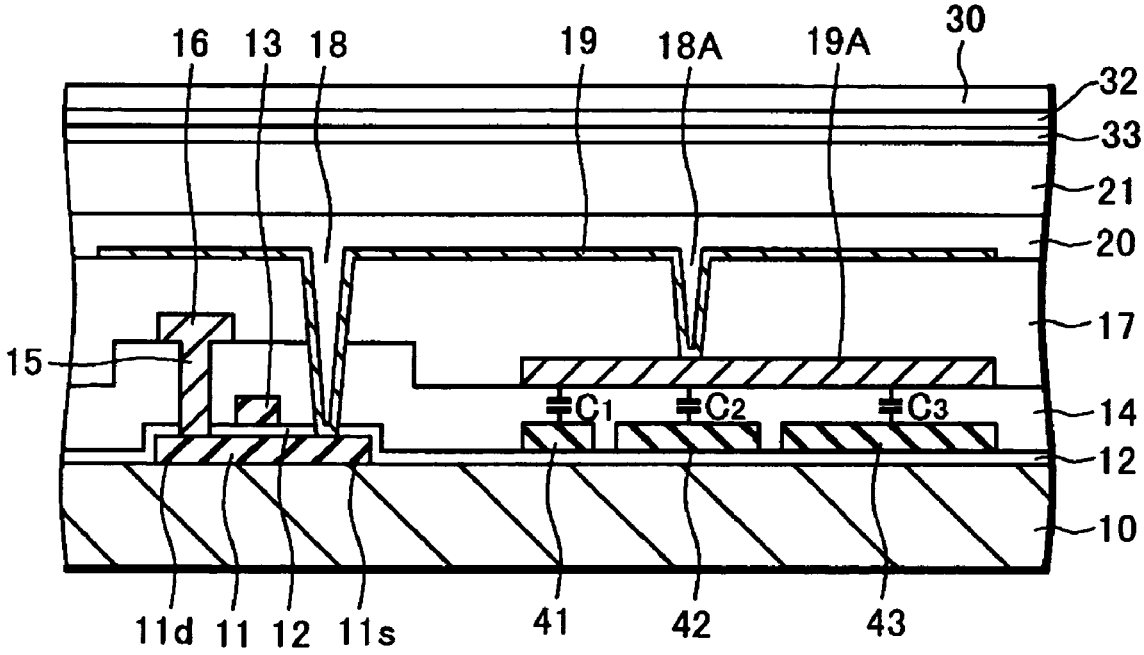
FIG. 8 is a cross-sectional view of a device configuration of another reflective liquid crystal display device used in the first embodiment.

FIG. 8 shows another device configuration of the reflective liquid crystal display device for the embodiments described above. In this configuration, the pixel electrode 19 is connected to an electrode 19A provided on the interlayer insulating film 14 through a contact hole 18A provided in the planarization insulating film 17. The capacitor electrodes 41, 42, and 43 are formed on the gate insulating film 12. Accordingly, the capacitor electrodes 41, 42, and 43 are coupled to the pixel electrode 19 through the electrode 19A.

Figure 9:
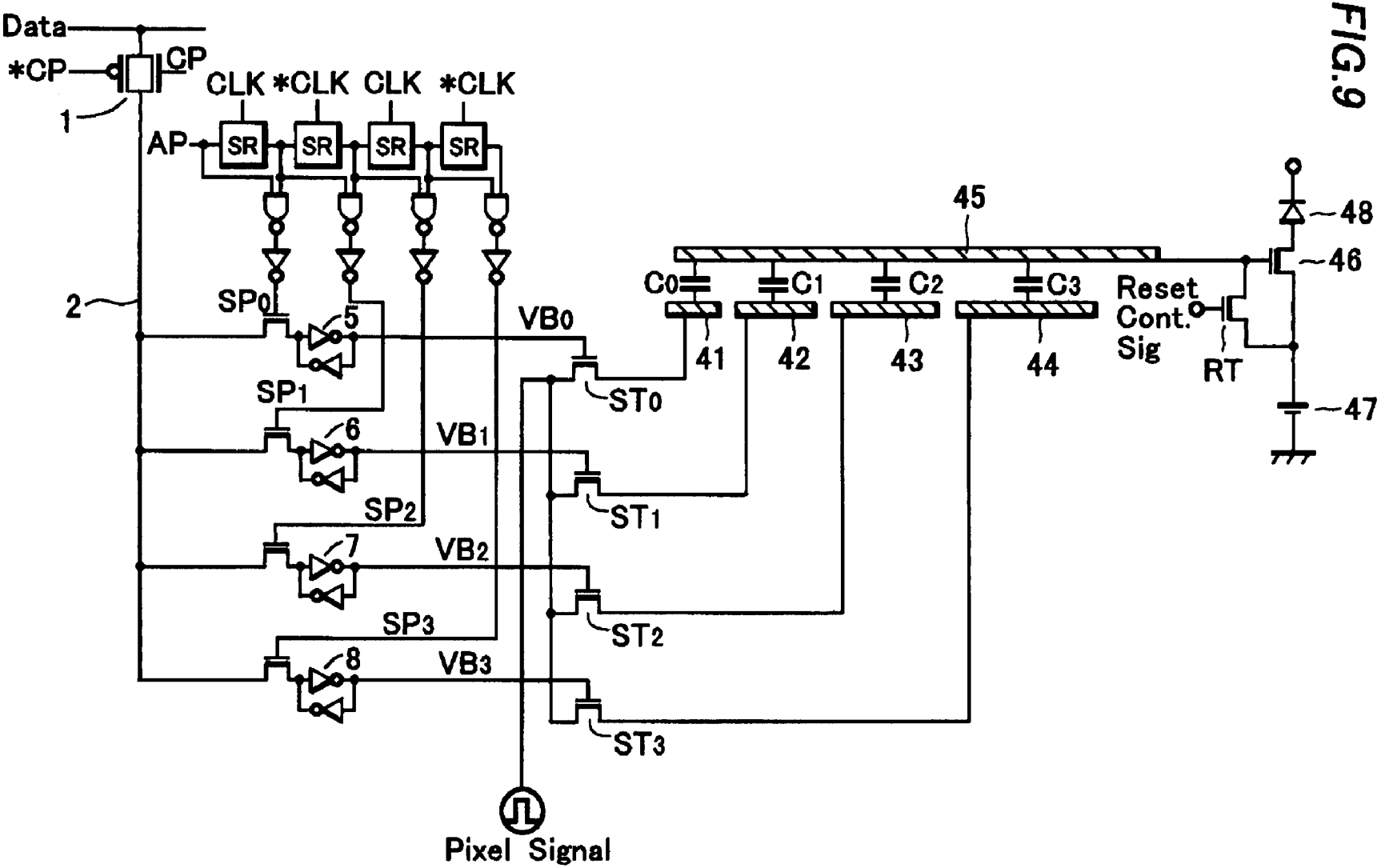
FIG. 9 is a circuit block diagram of an electroluminescent display device according to a third embodiment of the invention.
Figure 10:
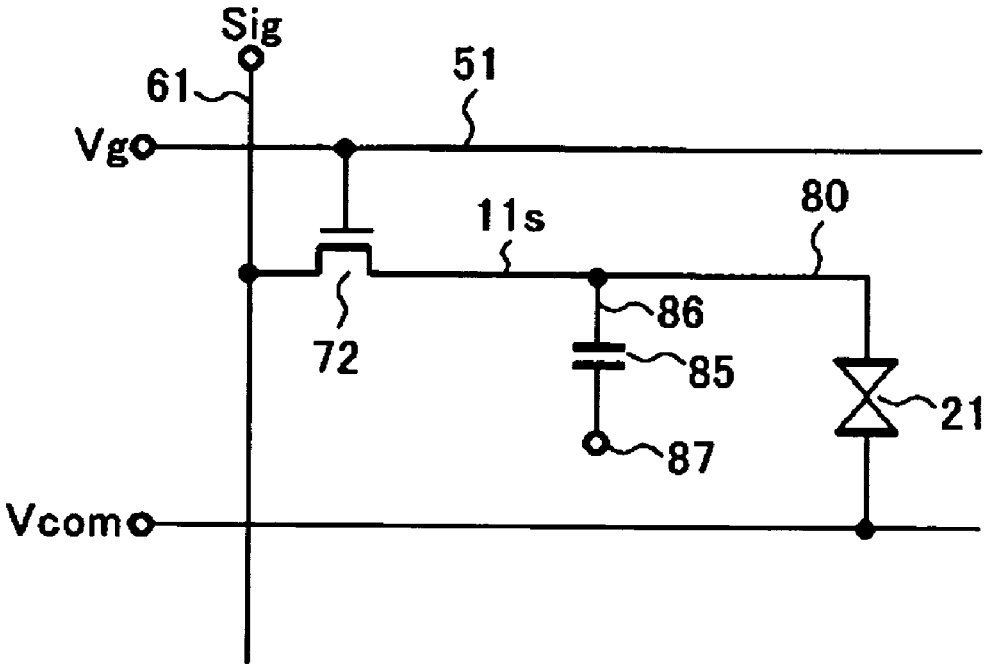
FIG.10 PRIOR ART
FIG. 10 is a circuit block diagram of a conventional liquid crystal display device.

Next, a display device according to a third embodiment of the invention will be described with reference to FIG. 9. FIG. 9 is a circuit diagram of the display device of the third embodiment. Although this figure shows a single pixel for simplification, the display device has a plurality of the pixels arranged in a matrix. The same reference numerals as those of FIG. 1 are given to the same elements as those of FIG. 1, which are described in the first embodiment, and the descriptions thereof are omitted here.

The display device of the third embodiment is an electroluminescent display device. This embodiment is the same as the first and second embodiments in that a floating electrode 45 and a plurality of the capacitor electrodes 41 to 44 provided for the respective pixels are coupled to each other through capacitance coupling so that an electric potential of the floating electrode 45 changes. In this third embodiment, an EL driving transistor 46, a constant-current source 47, and an EL element 48 are provided in the display device. The EL element 48 is a light-emitting element emitting a light at luminance corresponding to the amount of an electric current flowing through the EL element 48. In this embodiment, the floating electrode 45 is connected to a gate of the EL driving transistor 46. In the EL driving transistor, a threshold is set so that electrical conductivity changes in response to the potential of the floating electrode 45. The electric current corresponding to the electric potential of the floating electrode 45 is supplied from the constant-current source 47 to the EL element 48, and the EL element 48 emits a light at luminance corresponding to the current. This embodiment can be easily applied to a current-driven display device by replacing the EL element 48 by other light-emitting elements such as an LED.

In the display devices of the above embodiments, a DA converter for converting a digital image signal to an analog image signal is provided in a pixel, thereby simplifying a configuration of peripheral circuits of the pixel and reducing the frame area accordingly. Furthermore, the digital image signal data are serially transferred to each of the pixels from the outside, converted from serial signal data to parallel signal data, and then converted from digital signal data to analog signal data. Therefore, comparing to parallel transfer of the digital image signal data, the number of wirings used for data transfer and the area for wiring lines in each of the pixels can be reduced, thereby providing a high-definition display device displaying a multiple gray-scale image.

What is claimed is:

1. A display device comprising a plurality of pixels, each of the pixels comprising:

a serial-to-parallel converter converting a serial digital image signal supplied serially to the display device to a parallel digital image signal;

a DA converter converting the parallel digital image signal to an analog image signal; and a pixel electrode configured to receive the analog image signal, wherein the serial-to-parallel converter is connected to a drain signal line supplied with the serial digital image signal, and comprises a plurality of pixel selecting transistors connected to the drain signal line and a plurality of shift registers, each of the shift registers supplying a sampling pulse to a gate of a corresponding pixel selecting transistor for sampling the serial digital image signal at a predetermined timing.

2. A display device comprising a plurality of pixels, each of the pixels comprising:

a serial-to-parallel converter converting a serial digital image signal supplied serially to the display device to a parallel digital image signal;

a DA converter converting the parallel digital image signal to an analog image signal; and a pixel electrode configured to receive the analog image signal, wherein the DA converter comprises a plurality of capacitor electrodes coupled with the pixel electrode, each of the capacitance electrodes having a weighted capacitance ratio to couple with the pixel electrode, and a clock supplying portion supplies a periodic clock signal to the capacitor electrodes in response to the parallel digital image signal.

3. The display device of claim 2, wherein areas of the capacitance electrodes are weighted to reflect corresponding bits of the parallel digital image signal.

4. A display device comprising:

a drain signal line configured to receive a serial digital image signal serially supplied to the display device;

a plurality of pixel selecting transistors connected to the drain signal line and selecting a pixel of the display device;

a plurality of shift registers, each of the shift registers supplying a sampling pulse to a gate of a corresponding pixel selecting transistor for sampling the serial digital image signal at a predetermined timing to produce a parallel digital image signal;

a data retaining portion retaining the parallel digital image signal converted from the serial digital image signal;

a pixel electrode of the pixel;

a plurality of capacitor electrodes coupled with the pixel electrode, each of the capacitance electrodes having a weighted capacitance ratio to couple with the pixel electrode; and a clock supplying portion supplying a periodic clock signal to the capacitor electrodes in response to the parallel digital image signal retained in the data retaining portion.

5. The display device of claim 4, wherein areas of the capacitance electrodes are weighted to reflect corresponding bits of the parallel digital image signal.

6. The display device of claim 4, wherein the data retaining portion comprises a capacitor.

7. The display device of claim 6, wherein the data retaining portion comprises at least one additional capacitor and the number of total capacitors in the pixel corresponds to the number of bits of the parallel digital image signal.

8. The display device of claim 4, wherein the data retaining portion comprises a static memory circuit.

9. The display device of claim 8, wherein the data retaining portion comprises at least one additional static memory circuit and the number of total static memory circuits in the pixel corresponds to the number of bits of the parallel digital image signal.

* * * * *